US007063656B1

(12) United States Patent
Lindsay

(10) Patent No.: US 7,063,656 B1
(45) **Date of Patent: *Jun. 20, 2006**

(54) FOLDER WITH TELESCOPING STACKER AND SET FEEDER

(75) Inventor: Timothy D. Lindsay, Dover, NH (US)

(73) Assignee: Bescorp, Inc., Dover, NH (US)

( * ) Notice: Subject to any disclaimer, the term of this patent is extended or adjusted under 35 U.S.C. 154(b) by 14 days.

This patent is subject to a terminal disclaimer.

(21) Appl. No.: 10/921,279

(22) Filed: Aug. 19, 2004

Related U.S. Application Data

(63) Continuation-in-part of application No. 10/456,419, filed on Jun. 5, 2003.

(51) Int. Cl.
*B31F 1/08* (2006.01)

(52) U.S. Cl. ..... 493/419; 493/440

(58) Field of Classification Search ..... 493/435, 493/436, 440, 419, 420, 424, 434, 442; 271/9.01, 271/9.07; 414/790.4, 790.9
See application file for complete search history.

(56) References Cited

U.S. PATENT DOCUMENTS 1,782,323 A * 11/1930 Spiess ..... 493/353
3,495,818 A 2/1970 Marin
4,394,009 A 7/1983 Bergman et al.
4,909,779 A * 3/1990 Schaffron ..... 493/235
4,966,358 A * 10/1990 Yokoi et al. ..... 271/10.11
5,033,729 A * 7/1991 Struthers ..... 271/10.06
5,040,663 A 8/1991 Gould et al.
5,054,757 A 10/1991 Martin et al.
5,069,434 A 12/1991 Sellers
5,175,583 A * 12/1992 Noh et al. ..... 399/107
5,203,552 A 4/1993 Hoshi et al.
5,246,221 A 9/1993 Sugimoto et al.
5,246,621 A 9/1993 Favre et al.
5,269,744 A * 12/1993 Moll ..... 493/421
5,437,442 A 8/1995 Petersen
5,454,554 A * 10/1995 Boughton et al. ..... 271/9.01
5,520,603 A * 5/1996 Bluthardt et al. ..... 493/421
5,785,638 A 7/1998 Bristo et al.
5,820,334 A * 10/1998 Darcy et al. ..... 414/798.1
5,863,373 A 1/1999 Traise et al.
6,080,251 A 6/2000 Baker et al.
6,080,259 A 6/2000 Nadeau et al.
6,086,698 A 7/2000 Spitler
6,145,831 A 11/2000 Inoue et al.
6,153,048 A 11/2000 Abramson et al.
6,226,959 B1 5/2001 Krasuski et al.

(Continued)

*Primary Examiner*—Stephen F. Gerrity
*Assistant Examiner*—Paul Durand
(74) *Attorney, Agent, or Firm*—Ryan Kromholz & Manion, S.C.

(57) ABSTRACT

A folder includes a set feeder that by-passes the folder in-feed station. Sets of multiple sheets are directed directly to the folder processing station, such as a folder station. The set feeder comprises a guide mechanism that guides a set through a cover opening and along a lower guide to the input of the processing station. A sensing device senses the presence of the set and operates the processing station without operating the in-feed station. Alternately, a sensing device is not required, and the folder is operable to process sets using the set feeder by manually assuring that the in-feed station does not simultaneously propel any sheets to the processing station. The folder further comprises a telescoping stacker that holds the number of processed sheets equal to at least the number of sheets loaded at the in-feed station.

21 Claims, 10 Drawing Sheets

U.S. PATENT DOCUMENTS 6,244,585 B1 6/2001 Yoshiura et al.
6,264,592 B1 7/2001 Lindsay
6,474,884 B1 * 11/2002 Chiu ..... 400/624
6,554,271 B1 4/2003 Lindsay et al.
6,644,646 B1 11/2003 Lindsay et al.
6,719,680 B1 4/2004 Hosoya et al.
6,916,020 B1 * 7/2005 Hasegawa ..... 271/171
2002/0185045 A1 12/2002 Sato

* cited by examiner

FOLDER WITH TELESCOPING STACKER AND SET FEEDER

This is a continuation-in-part application of pending U.S. patent application Ser. No. 10/456,419 filed Jun. 5, 2003.

BACKGROUND OF THE INVENTION

1. Field of the Invention

This invention pertains to processing thin sheets of material, and more particularly to apparatus that feeds, processes, and stores large numbers of individual or sets of thin sheets.

2. Description of the Prior Art

Numerous types of equipment have been developed to process sheets of paper. For example, machines for feeding, folding, and sealing paper sheets are well known and in widespread use.

Some prior machines combine the functions of folding and sealing paper sheets. Representative combination folding and sealing machines may be seen in U.S. Pat. Nos. 6,080,251; 6,080,259; 6,086,698; and 6,264,592. Typical mechanisms for feeding paper sheets are shown in U.S. Pat. Nos. 4,394,009; 5,246,221; and 6,145,831. U.S. Pat. No. 6,554,271 discloses a gate tip paper feeder that may be used with a paper folding machine.

Most prior sheet processing equipment was limited to handling only one sheet at a time. Although there have been exceptions, in general considerable effort was expended in the past to prevent more than one sheet from feeding at a time, because feeding multiple sheets was likely to cause jams downstream. In some equipment, a supply stack of multiple sheets was loaded at an in-feed station, but only one sheet at a time was removed from the stack for being propelled downstream for processing. In other equipment, the sheets were supplied individually from a source such as a printer to a downstream station for further processing.

In many situations it is desireable to fold two or more sheets together as a single set. Most prior folding equipment was not capable of performing that function, because, as mentioned, the feeding devices of the prior machines could not feed more than one sheet at a time, so there was no way to propel multiple sheets together to the folding mechanism. One prior machine was capable of folding more than one sheet at a time as a set. That machine was limited to folding sheets that were fed by hand to the folding mechanism, however. It was not capable of feeding sheets one at a time from a supply stack or other equipment to the folding mechanism.

Another problem with prior sheet feeding and folding machines was that they could not hold all the folded sheets that came from a supply stack. The machines normally included an output tray that held the folded sheets. However, the tray was too small to hold the number of folded sheets equal to the capacity of the machine at the supply stack. Consequently, an operator had to be present and remove the folded sheets from the output tray. Otherwise the folded sheets would spill off the output tray onto the floor.

Thus, a need exists for a way to process multiple sheets simultaneously, as well as for other improvements to sheet processing equipment.

SUMMARY OF THE INVENTION

In accordance with the present invention, a folder is provided that is capable of processing both individual sheets and multiple-sheet sets. This is accomplished by apparatus that includes both a sheet in-feed station and a set feeder that guides the sets directly to a processing station.

The folder in-feed station propels sheets one at a time in a downstream direction from a source of the sheets to the processing station. The source of sheets may be other equipment, such as a printer, that discharges sheets directly to the folder of the invention. In one embodiment of the invention, the source of sheets is a feed mechanism having a tiltable hopper on which a supply stack of sheets is loaded. The feed mechanism includes a pickoff wheel and is operable to remove one sheet at a time from the supply stack and propel the sheets in the downstream direction to the processing station, such as a folding mechanism. After the processing has been completed, the sheets are discharged from the processing station.

The set feeder is located between the in-feed station and the processing station. In its simplest form, the set feeder comprises a cover in the frame of the folder. The cover defines an elongated opening near the inlet of the processing station. A person inserts a set of sheets, which may be stapled together, through the cover opening. The cover opening directs the set to the processing station, which folds or otherwise processes the set.

According to another aspect of the invention, the set feeder includes a guide mechanism that is removeably mounted to the cover. The cover opening is along the base of the guide mechanism. Preferably, there is a lower guide inside the cover and aligned with the opening and the guide mechanism. The lower guide has an end that is close to the inlet of the processing station. The lower guide may be used in combination with the guide mechanism, or the lower guide may be used without using the guide mechanism.

In the lower guide and close to the cover opening is a sensing device. The sensing device is connected electrically to a motor that operates the processing station. For example, the processing station may be a folding mechanism. In that case, the motor operates a series of rollers that propel sheets through the folding mechanism.

In a first mode of operation of the folder, the in-feed station propels one sheet at a time in the downstream direction from the supply stack or other source. The sheets enter the processing station, where they are processed according to the manner of the particular machine.

In a second mode of operation of the folder, the in-feed station is not operated. Instead, a person places a set of multiple sheets, which may be stapled together, against the set feeder guide mechanism. The set of sheets is slid down the guide mechanism such that its leading edge enters the cover opening. The paper slide guides the set leading edge to the input of the processing station, such as the input nip of a folding mechanism.

As the leading edge of the set of sheets enters the cover opening, the sensing device signals the motor to activate the processing station, such as the rollers of a folding mechanism. However, the in-feed station does not operate, so no sheets are propelled downstream from there. The input nip rollers contact the set top and bottom sheets and draw them together in the downstream direction through the rest of the folding mechanism or other processing station in the same manner as a single sheet. When the set is fully processed, it is discharged from the processing station. In one preferred embodiment of the invention, the motor stops running after a selected time and remains idle until another set is slid into the set feeder. In that manner, sets of sheets by-pass the in-feed station and are processed without danger of the sheets becoming separated from each other or jamming in the processing station. Further, the processing of the sets is completely independent of the supply sheets stacked at the in-feed station or other source of sheets. When no more sets of sheets are to be processed, the folder can be operated in the usual way to again process individual sheets from a supply stack at the in-feed station or from another source.

It is an important feature of the invention that the set feeder need not include a sensing device. In an alternate embodiment, the mechanical portions of the set feeder are identical to the embodiment described with the sensing device. The folder is controlled to operate the processing station, but not to propel any sheets to it from a stack or other supply source. Alternatively, the folder in-feed station may be operated in the normal way but without any sheets there. In either case, the operator slides the set of sheets along the guide mechanism and into the cover opening in the same way as with the sensing device embodiment. When the set has been processed, the folder can be operated in the normal way.

Further in accordance with the present invention, the folder is capable of holding a number of processed sheets equal to or greater than the number of sheets in the supply stack loaded at the in-feed station. For that purpose, the processed sheets are discharged from the processing station onto a telescoping stacker. The telescoping stacker comprises a deck and at least one extension tray. One end of the deck is fixed to the folder frame. The extension tray is slideable on the deck between a retracted location and an extended location. In the retracted location, the extension tray is nested inside the deck. In the extended location, the extension tray extend; from the deck.

The folder may have an output conveyor at the downstream end of the processing station. In that case, the deck supports a downstream shaft of the conveyor. The extension tray is almost entirely under the conveyor and is nested in the deck when the extension tray is in the retracted location. A stop on the extension tray contacts the conveyor downstream shaft to set the extended location for the extension tray.

During operation of the folder, the extension tray is normally pulled to its extended location. The processed sheets are discharged onto the extension tray, which holds a large number of them. For even greater holding capacity, a second tray is incorporated into the telescoping stacker. The second tray is slideable along the extension tray between a retracted location where it nests within the extension tray and an extended location. When the second and extension trays are extended for their full lengths from the deck, the telescoping stacker can hold a number of processed sheets equal to or greater than the capacity of the paper in-feed station supply stack. Consequently, the folder of the invention can be operated for its full capacity without the presence of an operating person.

The method and apparatus of the invention, using a set feeder, thus enables the folder to either process sheets one at a time, or process sets of sheets. The folder is capable of holding a number of processed sheets equal to the number of sheets at the in-feed station, even though an operator need not be present during processing operations.

Other advantages, benefits, and features of the present invention will become apparent to those skilled in the art upon reading the detailed description of the invention.

DETAILED DESCRIPTION OF THE INVENTION

General

Figure 1:
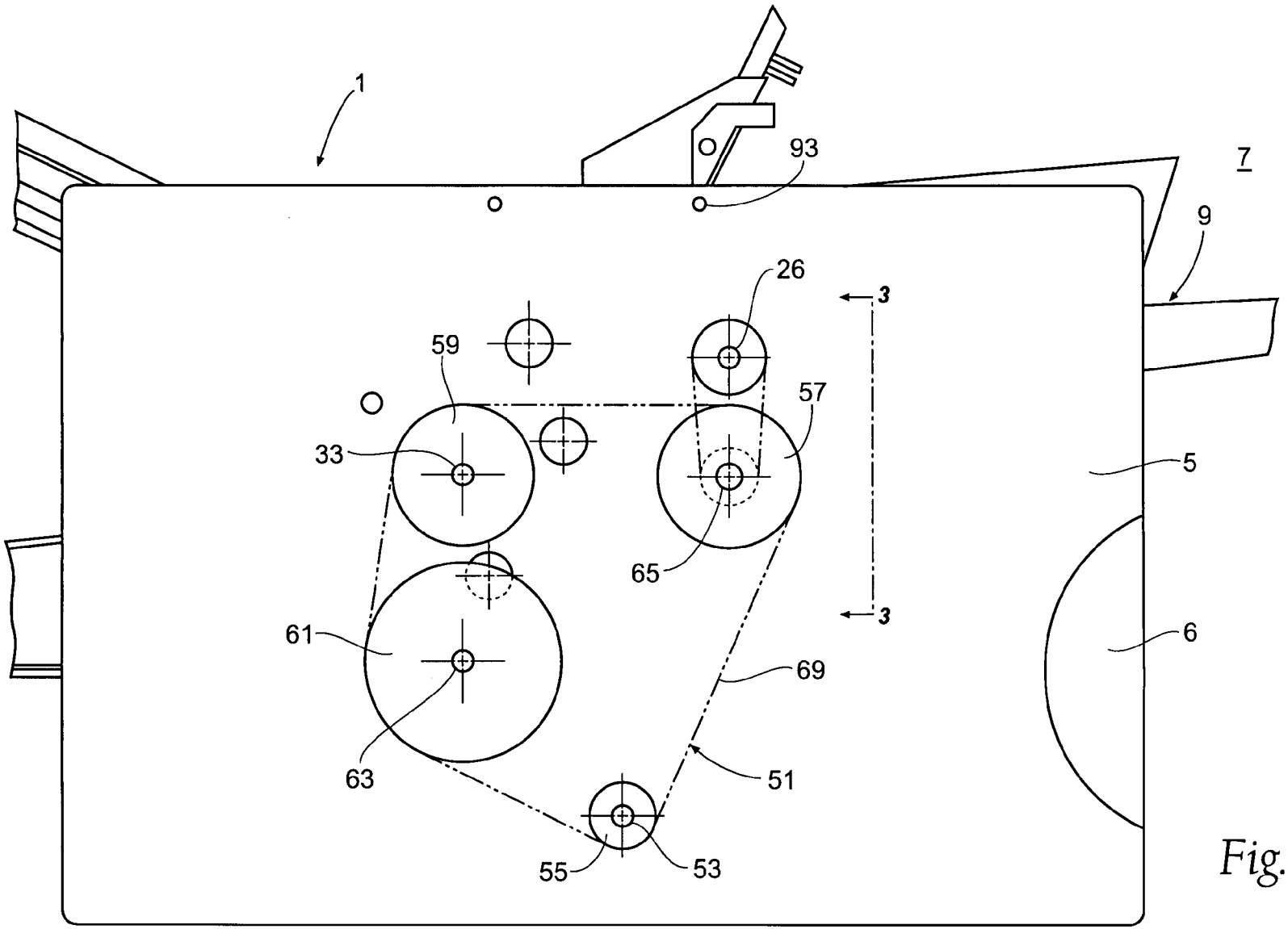
FIG. 1 is a broken partial front view of the folder of the invention.

Referring first to FIGS. 1, 2, 2A, and 5, a sheet processing machine 1 is illustrated that includes the present invention. The particular sheet processing machine 1 is in the general form of a paper folding machine, and the machine will be referred to as a folder 1. However, it will be understood that the invention is not limited to any particular type of sheet processing equipment.

The folder 1 has a frame 3 that includes parallel side walls 5 and 6. The side walls 5 and 6 define a longitudinal center plane 100 of the folder. At an upstream end 7 of the folder is an in-feed station that supplies individual sheets in a downstream direction 11 from a source of sheets to a processing station. For example, the source may be a printer or other equipment, not shown, located in the upstream direction 8 of the folder. In the particular in-feed station 9 shown, the source of sheets is a supply stack represented at phantom line 12. In the downstream direction 11 from the in-feed station 9 is a folder station 13.

Figure 2:
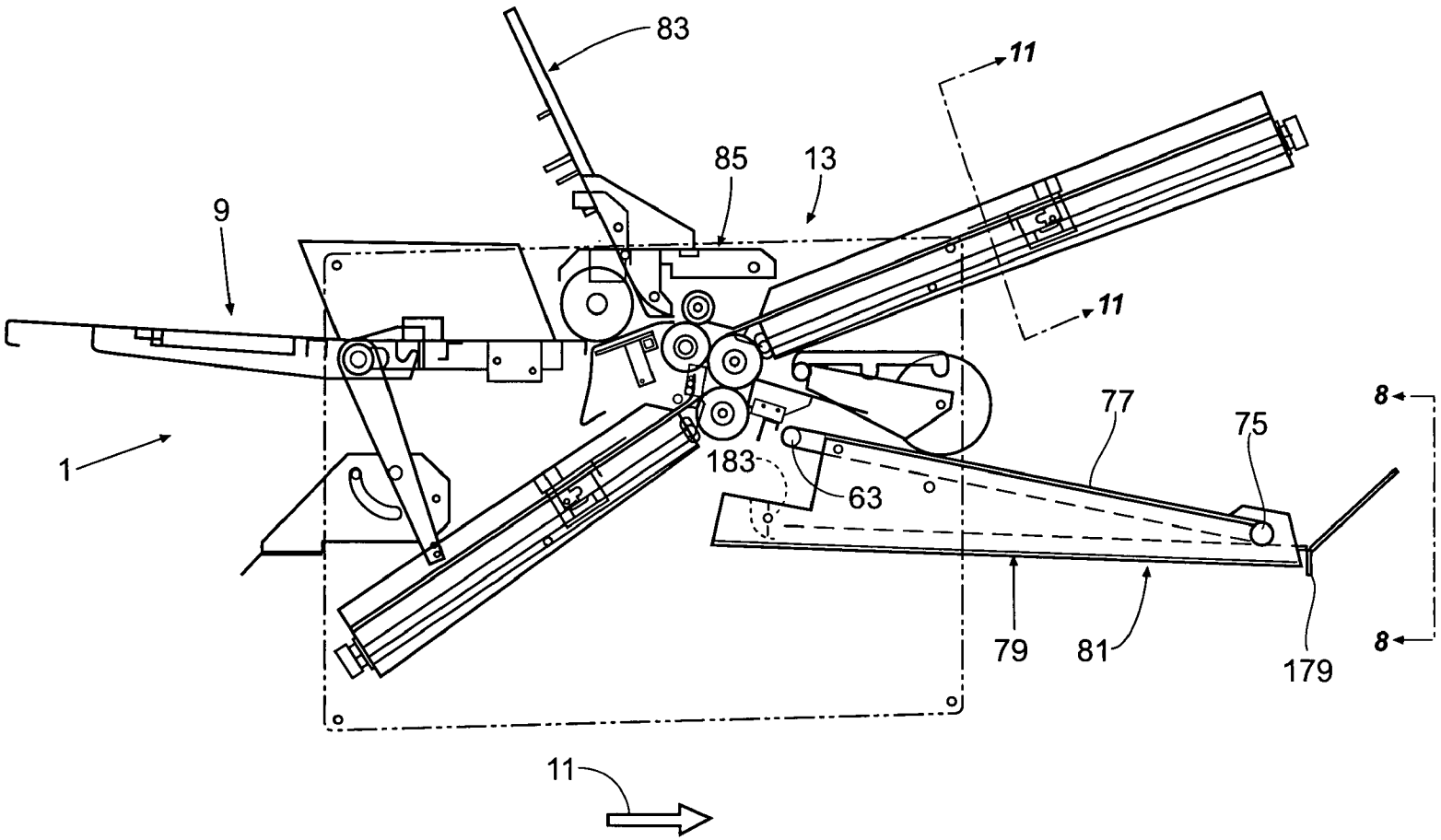
FIG. 2 is a partial back view of the present invention.
Figure 2A:
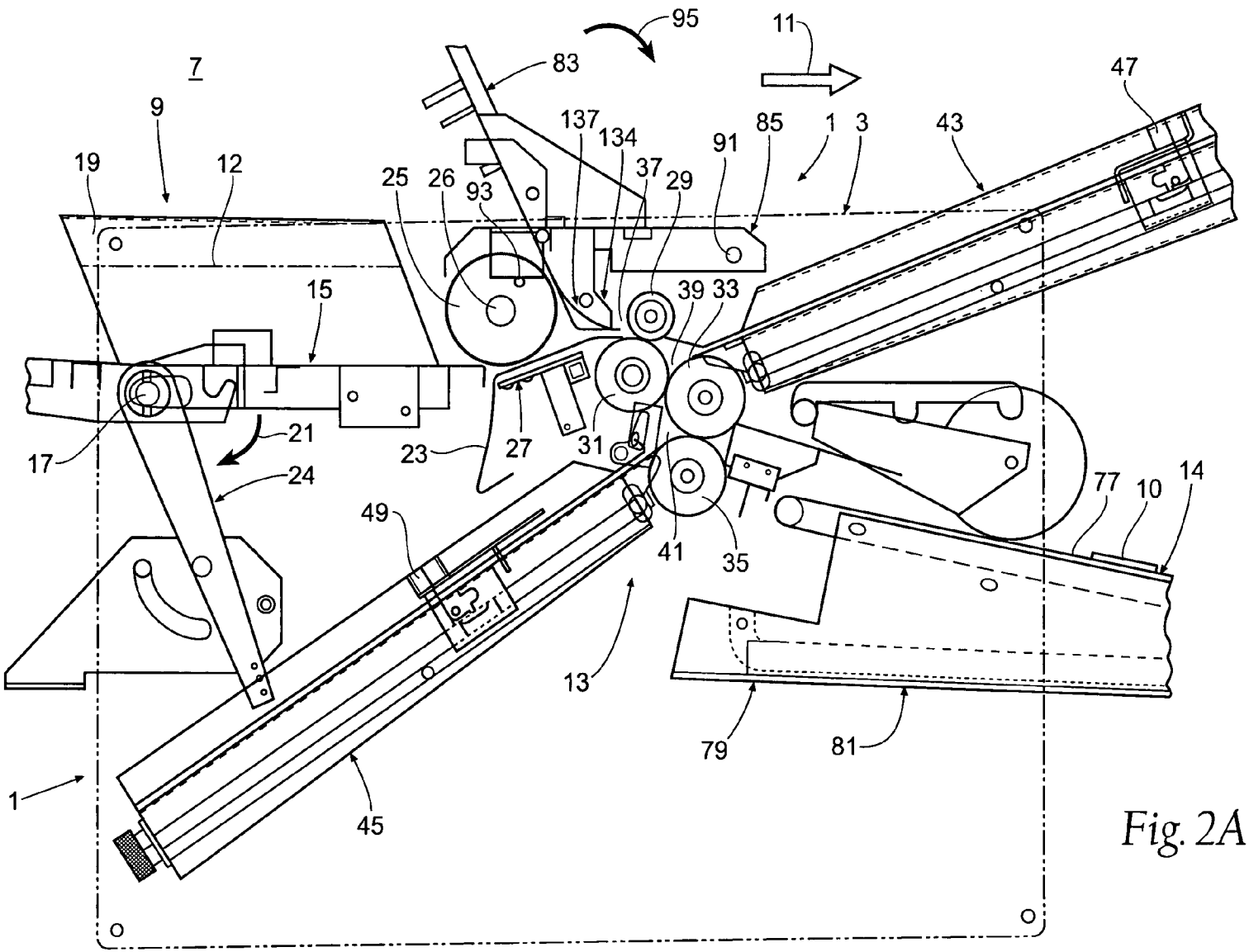
FIG. 2A is an enlarged view of selected portions of FIG. 2.
Figure 4:
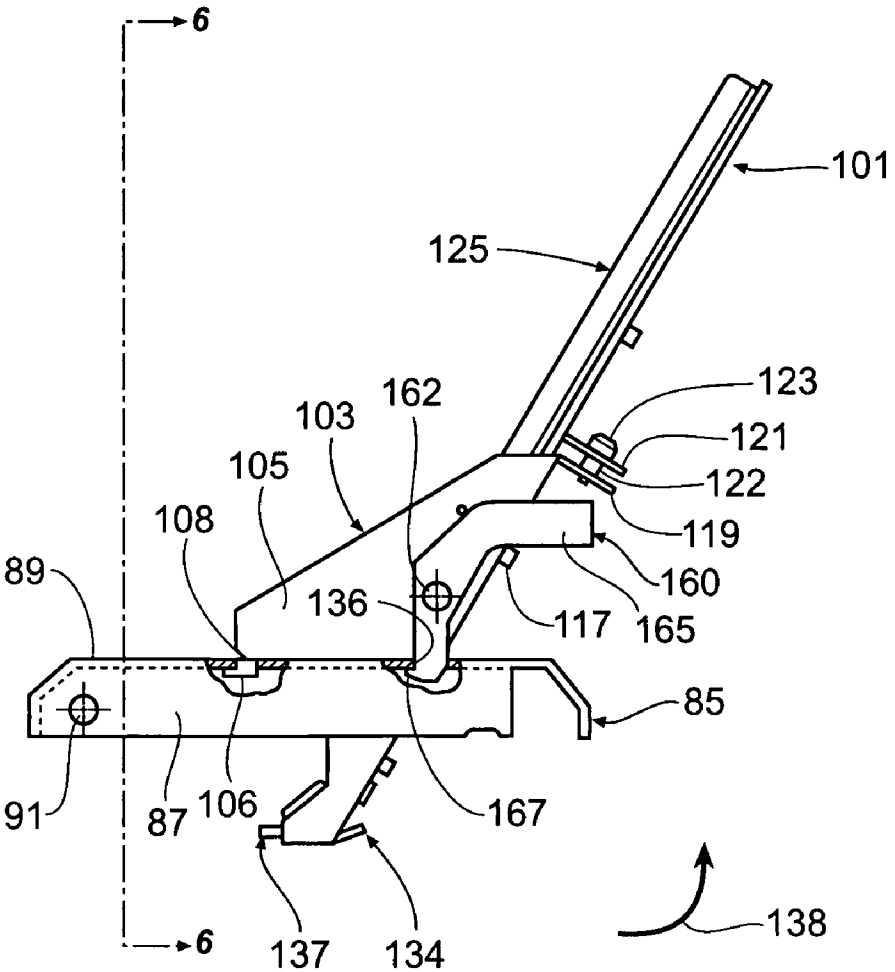
FIG. 4 is a broken front view of the set feeder of the present invention.

Looking also at FIG. 4, a cover 85 extends between the frame side walls 5 and 6 and overlies the folder station 13. The cover 85 has side walls 87 and a top wall 89. There is a pin 91 in each cover side wall 87 that protrudes into the adjacent frame side wall. The pins 91 are close to the downstream end of the cover. In each frame side wall near the upstream end of the cover as a second pin 93. As shown in FIGS. 1 and 2, the cover is in a working position whereat the cover side walls rest on the associated pins 93, and the cover top wall 89 is generally horizontal. When the cover is in the working position, it generally overlies the folder station 13. From the working position, the cover is pivotable in the direction of arrow 95 about the pins 91 to an open position. When the cover is in the open position, it is generally vertically oriented, and the folder station is open from the top of the folder 1.

The sheets are propelled one at a time from the supply stack 12 or other source in the downstream direction 11 to the folder station 13. After being folded, the finished sheets 10 are discharged from the folder 1. The specific folder illustrated is shown equipped with an output conveyor 14, but an output conveyor is not necessary for the proper functioning of the present invention. After folding is completed at the folder station, the sheets are deposited onto the output conveyor 14.

In-Feed Station

The in-feed station 9 is comprised of a hopper 15 that is rotatable in the frame walls 5 and 6 by means of a shaft 17. The supply stack 12 of paper sheets is loaded on the hopper 15 between side guide plates 19. The weight of the supply stack causes the hopper 15 to pivot in the direction of arrow 21 about the shaft 17. The leading edges of the sheets are held in place along a curved front guide 23. A counterbalance system collectively represented at reference numeral 24 causes the topmost sheet in the supply stack to press against a pickoff wheel 25 of a feed mechanism 27. The pickoff wheel 25 is connected to a shaft 26 that is rotatable in the frame 3.

Paper feed mechanisms are well known in the art, and any of a wide variety of feed mechanisms may be used with the folder 1. An exemplary paper feed mechanism is disclosed U.S. Pat. No. 6,554,271. The feed mechanism 27 propels one sheet at a time from the supply stack 12 in the downstream direction 11 to the folder station 13.

As mentioned above, the particular in-feed station 9 is not mandatory to the operation of the folder 1. Any source of individual sheets, such as a printer, may be used to propel the sheets in the downstream direction 11 to the folding station 13.

Folder Station

The particular construction of the folder station 13 is not critical to the functioning of the folder 1. As illustrated, the folder station is comprised of four rollers 29, 31, 33, and 35. The rollers 29 and 31 cooperate to form an input nip 37. The rollers 31 and 33 form an intermediate nip 39. The rollers 33 and 35 form an output nip 41. The folder station further has a first fold chute 43 and a second fold chute 45. The fold chutes 43 and 45 have respective stops 47 and 49. The stops 47 and 49 are adjustable to produce selected folded configurations to the sheets, as is well known in the folder art.

The folder station input nip 37 receives the leading edge of a sheet propelled from the feed mechanism 27 of the in-feed station 9. The sheet is propelled by the rollers 29 and 31 into the first fold chute 43 and up against the stop 47. The sheet is caught and folded along a first fold line in the intermediate nip 39. The rollers 31 and 33 of the intermediate nip propel the partially folded sheet to the second fold chute 45. The sheet is caught a second time and folded along a second fold line in the output nip 41. The rollers 33 and 35 of the output nip discharge the completely folded sheet 10 onto the output conveyor 14.

Drive Train

To operate the in-feed station and the folder station, the folder further comprises a drive train. The construction and operation of the drive train is dependent on the particular type of in-feed and processing stations may vary without affecting the scope of the invention. For example, the drive train may operate the in-feed station and the processing station independently of each other. The particular folder 1 illustrated has a drive train 51 that rotates the feed mechanism pickoff wheel 25 and the folder station rollers 29, 31, 33, and 35. The drive train 51 has an electric motor 53 with a pulley 55 on the motor shaft. An idler pulley 57 is mounted on a shaft 65 for rotation on the frame wall 5. There is another pulley 59 connected to the roller 33, and another pulley 61 connected to an upstream shaft 63 of the output conveyor 14. A timing belt 69 is trained around the pulleys 55, 57, 59, and 61. Energizing the motor 53 causes rotation of the pulleys 57, 59, and 61 and thus of the shafts and rollers 65, 33, and 63. The folder station rollers 29, 31, and 35 rotate because of friction between them and the roller 33.

Figure 3:
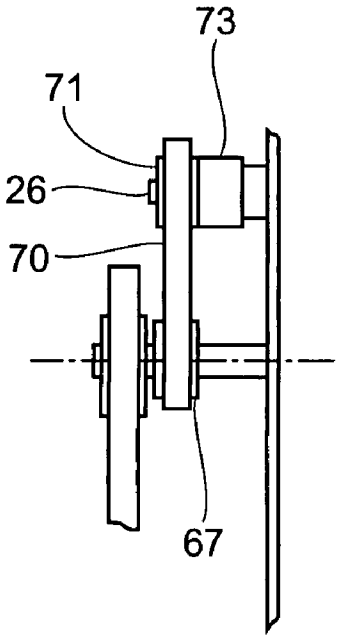
FIG. 3 is a partial view taken along line 3—3 of FIG. 1.
Figure 5:
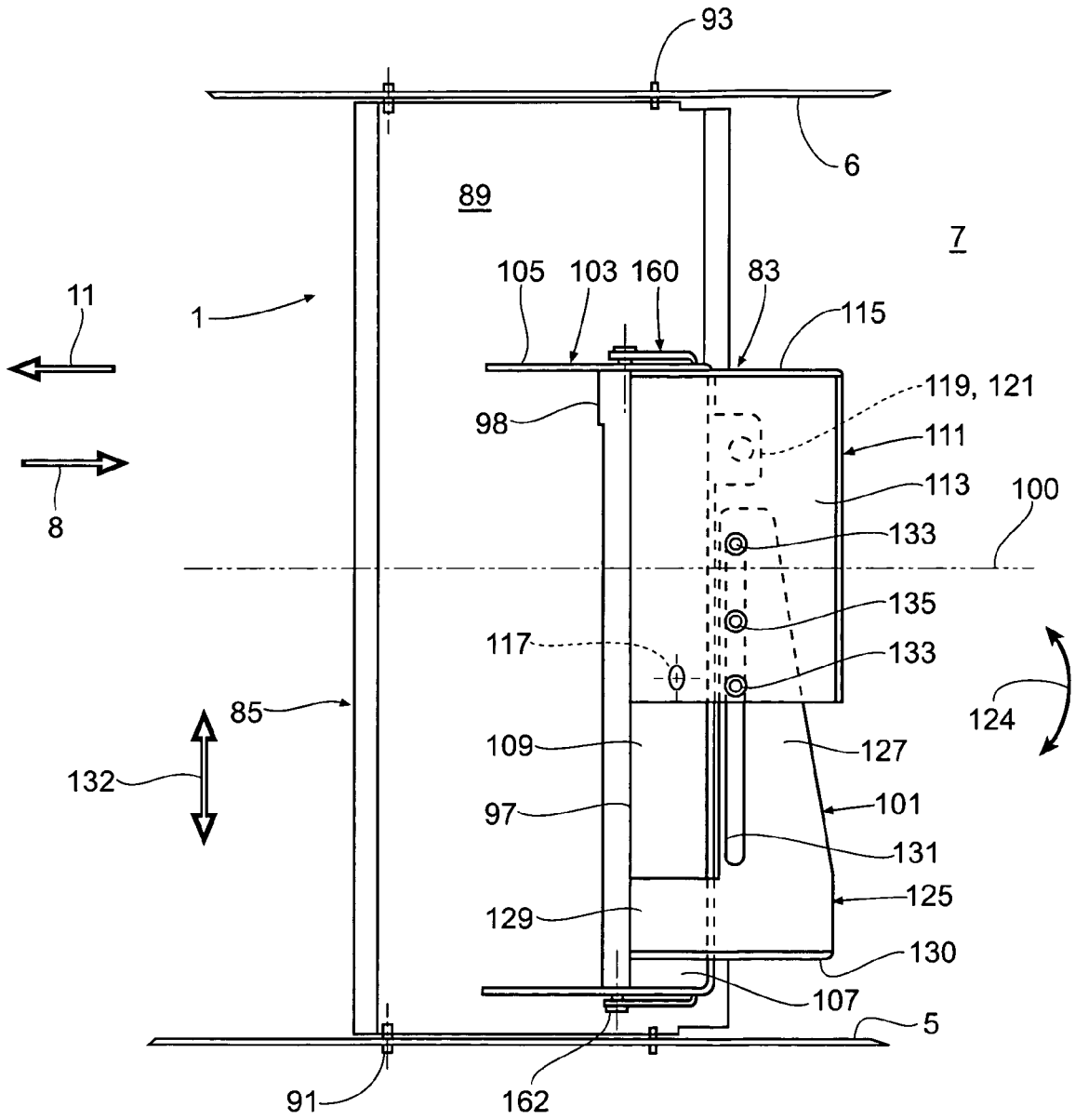
FIG. 5 is a top view of FIG. 4.

It is a feature of the present invention that on the shaft 65 with the idler pulley 57 is a second pulley 67, FIG. 3. A second timing belt 70 is trained over the pulley 67 and also over a pulley 71 that is on the shaft 26 of the in-feed station pickoff wheel 25. The pulley 71 is part of an electric clutch 73. When the clutch 73 is energized, the shaft 26 rotates together with the pulley 71. When the clutch 73 is de-energized, the shaft 26 does not rotate with the pulley 71.

Output Conveyor

In addition to the shaft 63, the output conveyor 14 also has a downstream shaft 75. The downstream shaft 75 is supported on a deck 79 of a telescoping stacker 81 that will be described in detail below. The deck 79 is fixed to the frame walls 5 and 6. One or more belts 77 are trained over the shafts 63 and 75. Operation of the electric motor 53 causes the upper flight of the belt 77 to travel in the downstream direction 11.

Set Feeder

In accordance with the present invention, a set feeder 83 is incorporated into the folder 1. The set feeder 83 enables multiple sheets of paper to be folded together as a set at the folder station 13 without jamming. Operation of the set feeder is independent of the operation of the feed station 9, as will be explained.

The set feeder 83 makes use of the cover 85 that overlies the folder station 13. Also see FIGS. 4 and 5. To accommodate the set feeder, an elongated transverse opening 97 is formed in the cover top wall 89. One end of the opening 97 has a short length 98 that is wider than the rest of the opening. The opening is offset from the longitudinal center plane 100 of the folder 1. As illustrated, the opening is closer to the frame side wall 5 than to the wall 6, but the reverse offset is also acceptable.

In its simplest form, the set feeder 83 utilizes only the opening 97 in the cover top wall 89. The opening 97 is located close to the input nip 37 of the folder station 13. The folder 1 is operated by inserting a set of sheets through the cover opening. The set of sheets may, but need not, be stapled together. The cover opening directs the set leading edge to the folder station input nip. The drive train 51 is controlled such that the in-feed station 9 does not propel any sheets in the downstream direction 11, but the folder station rollers 29, 31, 33, and 35 do rotate. The set is thus drawn into the folder station for complete folding and ultimate discharge from the folder.

In the illustrated embodiment, the set feeder 83 comprises a guide mechanism 101 that upstands from the cover 85. In the illustrated construction, the guide mechanism 101 includes a yoke 103. The yoke 103 has end plates 105 that span the length of the cover opening 97. The yoke end plates 105 have tabs 106 that fit into corresponding slots 108 in the cover top wall 89. Between the yoke end plates 105 is a back plate 107. The bottom 109 of the back plate 107 is close to the cover top wall opening.

Also part of the guide mechanism 101 is a back plane 111. The back plane 111 comprises a flat area 113 that overlies a portion of the yoke back plate 107. An end strip 115 is at a right angle to the flat area 113. The back plane is joined to the yoke by a fastener 117, such as a stud welded to the flat area and passing through a hole in the yoke back plate 107 and fastened with a nut.

To accommodate the tolerances inherent in the manufacture of the various components of the set feeder 83, the back plane 111 is adjustable relative to the yoke 103. For that purpose, the yoke and back plane have respective aligned tabs 119 and 121. A spring 122 is interposed between the tabs 119 and 121. A screw 123 is inserted through a hole in the back plane tab and through the spring 122 and is threaded into the yoke tab. By turning the screw 123, the back plane swivels in the directions of arrows 124 about the fastener 117, thereby changing the orientation of the end strip 115 relative to the cover opening 97.

The guide mechanism 101 further comprises an adjuster 125. According to one aspect of the invention, the adjuster 125 has a central plate 127 that partially underlies the flat area 113 of the back plane 111. The adjuster also has an end leg 129 that overlies part of the back plate 107 of the yoke 103. There is an edge strip 130 along the end leg 129. The adjuster is adjustable linearly in the directions of arrows 132 relative to the back plane and yoke by means of a slot 131 in the central plate 127. A pair of studs 133 or similar elements fixed to the back plane flat area pass through the adjuster slot 131 to slidingly guide the adjuster. A fastener 135, such as another stud with a nut, also fixed to the back plane flat area and passing thorough the adjuster slot, is used to lock the adjuster in place.

To mount the guide mechanism 101 to the cover 85, a pair of latches 160 are employed. Each latch 160 is pivotally connected by a respective pin 162 to an end plate 105 of the yoke 103. There is a finger end 165 on one side of the pin 162, and a hook 167 on the other side of the pin. The latch hooks 167 fit into slots 136 in the cover top wall 89. A torsion spring, not shown, fits over each pin 162. The torsion springs bias the latch hooks into engagement with the cover slots 136.

To remove the guide mechanism 101 from the cover 85, the latches 160 are manually pivoted against the torsion springs in the direction of arrow 138 to disengage the latch hooks 167 from the slots 136. The entire guide mechanism is tilted in the direction of arrow 138 such that the tabs 106 on the yoke 103 also disengage from the cover slots 108. The entire guide mechanism is thus easily removeable from and remountable to the cover.

Figure 6:
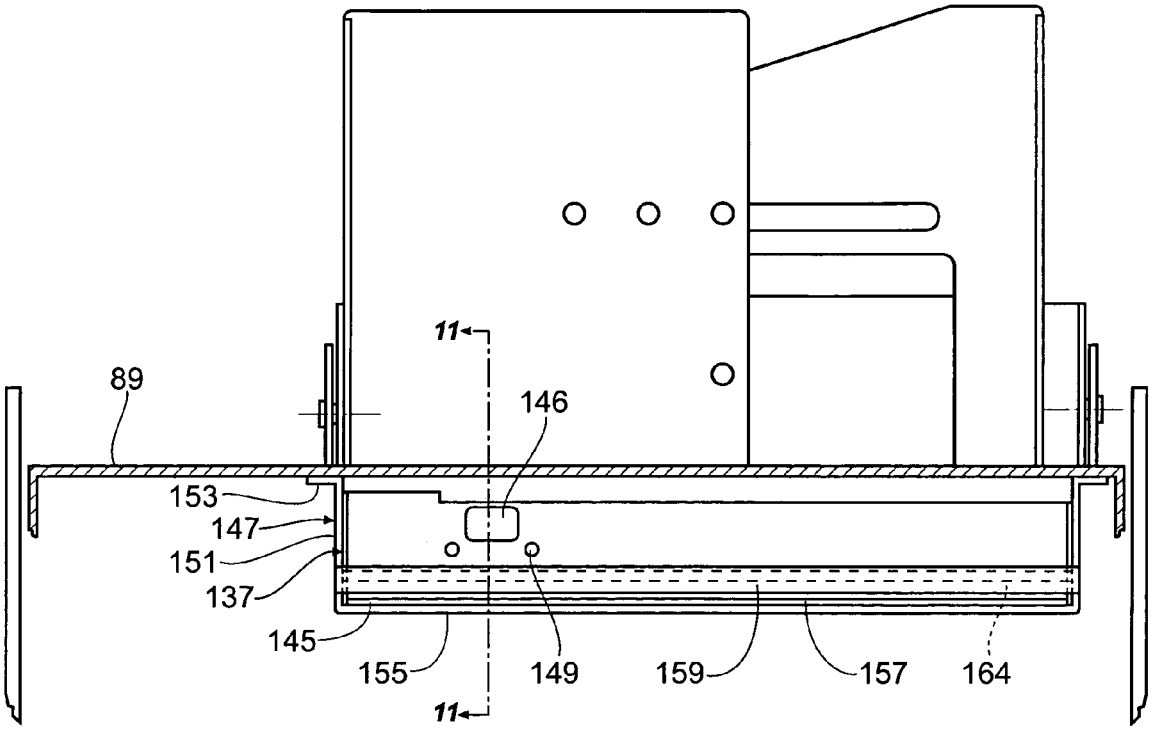
FIG. 6 is a cross-sectional view taken along line 6—6 of FIG. 4.
Figure 11:
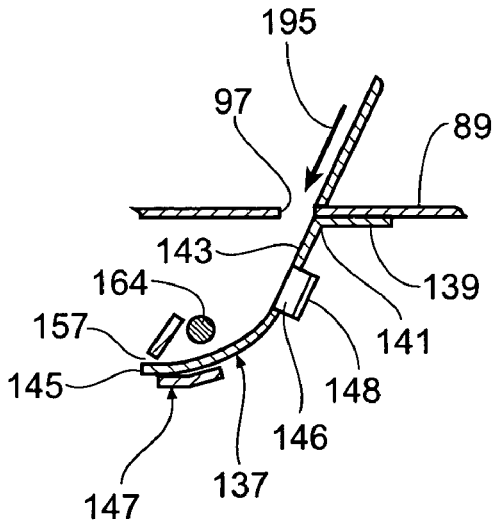
FIG. 11 is a cross-sectional view taken along line 11—11 of FIG. 6.

The set feeder 83 may also include a lower guide 134. See FIGS. 6 and 11. The lower guide 134 is illustrated as being in addition to the guide mechanism 101. However, the versatility of the present invention is such that the set feeder is operable with either the guide mechanism alone or with the lower guide 134 alone, as well as with the combination of the guide mechanism and the lower guide. The lower guide 134 is comprised of a paper slide 137. The paper slide 137 has an upper flange 139 that is welded or otherwise secured to the underside of the cover top wall 89. A junction 141 of the paper slide flange 137 with an angled section 143 is at the upstream edge of the cover opening 97. The paper slide angled section 143 curves with a large radius and terminates at an end 145 that is close to the input nip 37 of the folder station 13. In the paper slide angled section is an opening that receives a sensing device 146, such as a photoelectric eye. The sensing device 146 may be held in place to the paper slide angled section by a bracket 148 and fasteners 149.

There is a paper guide 147 associated with the paper slide 137. The paper guide 147 has a pair of end plates 151 that span the paper slide. The paper guide end plates 151 have respective flanges 153 that are welded to the cover top wall 89. A bottom plate 155 extends between the end plates and supports the paper slide end 145. A spanner bar 159 connects the paper guide end plates to each other. The spanner bar 159 is spaced a short distance from the paper slide end 145 such that there is a gap 157 between the spanner bar and the paper slide end. The gap 157 is close to the folder station input nip 37. There is also a guide rod 164 above the paper slide angled section 143 near the gap 157. The guide rod 164 is secured to the paper guide end plates.

Operation

Figure 7:
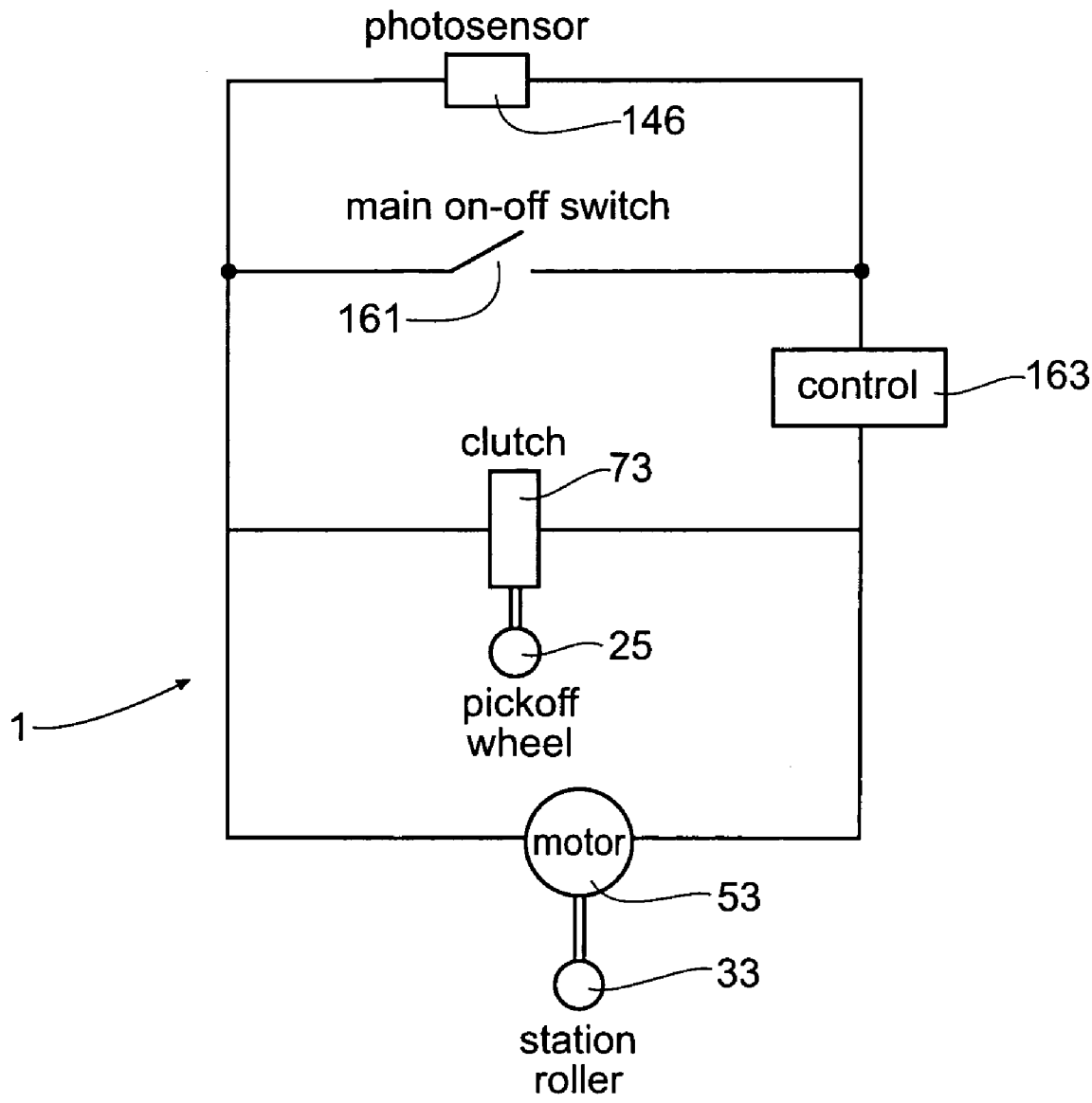
FIG. 7 is a simplified schematic diagram of the control circuit of the present invention.

FIG. 7 shows in schematic form the salient components used to control the operation of the folder 1. To operate the folder in the normal manner for folding sheets (FIG. 2A), a supply stack 12 is loaded on the feed station hopper 15. A main on-off switch 161 is closed. A control 163 energizes the clutch 73 and the motor 53. The motor pulley 55 (FIG. 1) drives the belt 69 to rotate the shafts 65 and 33 and also the pickoff wheel shaft 26 (FIG. 3). The folder thus operates as a normal sheet folding machine.

The set feeder 83 enables a set of multiple sheets to be folded together. For example, the sheets may be taken from a copy machine and stapled together. However, the folder 1 is also capable for folding multiple sheets that are not stapled together. To fold the set, the main switch 161 is opened. The fastener 135 of the adjuster 125 is loosened, and the adjuster is slid relative to the back plane 111 in the direction of arrow 132 such that the adjuster edge strip 130 is at the correct distance from the back plane end strip 115 for the width of the paper in the set. The studs 133 in the back plane guide the adjuster slot 131 when sliding the adjuster.

After the fastener 135 is retightened, the set of sheets is laid against the back plane 111 and adjuster 125. The side edges of the sheets are justified against the end strip 115 of the back plane 11 and the edge strip 130 of the adjuster 125. A leading edge of the set is placed close to the cover opening 97. If the set is stapled, the staple is aligned with the opening wider length 98. The set is slid down into the opening in the direction of arrow 195, FIG. 11, and into contact with the paper slide 137. As soon as the sensing device 146 senses the leading edge of the set, the control 163 operates to energize the motor 53 and thus turn the rollers 29, 31, 33, and 35 at the folder station 13. However, the control does not energize the clutch 73, so the pickoff wheel 25 does not operate to feed any sheets from the supply stack 12 at the in-feed station 9. The leading edge of the set of sheets is guided along the paper slide angled section 143 toward the gap 157. The guide rod 164 assures that the set of sheets slides properly to the gap. From the gap, the set of sheets enters the input nip 37 of the folder station. The set is folded in the same manner as a single sheet, but the set by-passes the in-feed station. After processing, the set 10 is discharged onto the output conveyor 14. After the motor as been energized a selected time, such as five seconds, the motor is de-energized. At that point, the folder 1 is ready either to be turned on by means of the switch 161 for folding individual sheets in the normal manner, or to receive another set of sheets through the set feeder 83 and cover opening.

According to another aspect of the invention, the electric clutch 73 and the sensing device 146 are not required. Rather, the belt 69 is trained over a pulley, not illustrated in the drawings, directly on the pickoff wheel shaft 26. Consequently, the shaft 26 always rotates whenever the motor 53 is energized. When a person wants to fold a set of sheets, he places the set against the guide mechanism 101 as described previously. If no supply stack 12 of sheets is at the in-feed station hopper 15, the person turns on the folder main on-off 161 switch and slides the set in the direction of arrow 195 through the cover opening 97. The folder 1 functions to fold the set as previously described.

If, however, a supply stack 12 of sheets is loaded at the in-feed station hopper 15, the person manually tilts the hopper about the shaft 17 in the direction of arrow 21 such that the sheets are out of contact with the pickoff wheel 25.

Then the person turns on the main on-off switch 161 and slides the set through the cover opening 97. In that way, a conventional control may be used to fold sets with the set feeder 83. As mentioned, other drive trains and modes of operation of the in-feed station are also usable with the set feeder of the invention.

Telescoping Stacker

Further in accordance with the present invention, the folder 1 is capable of holding at least as many folded sheets 10 as the capacity of the in-feed station hopper 15. After processing, the completed sheets are discharged from the folder. If the folder is not equipped with the output conveyor 14, the finished sheets are discharged directly to the telescoping stacker 81. If the folder is equipped with the output conveyor 14, the finished sheets are deposited on the belts 77, and the conveyor propels the completed sheets to the telescoping stacker.

Figure 8:
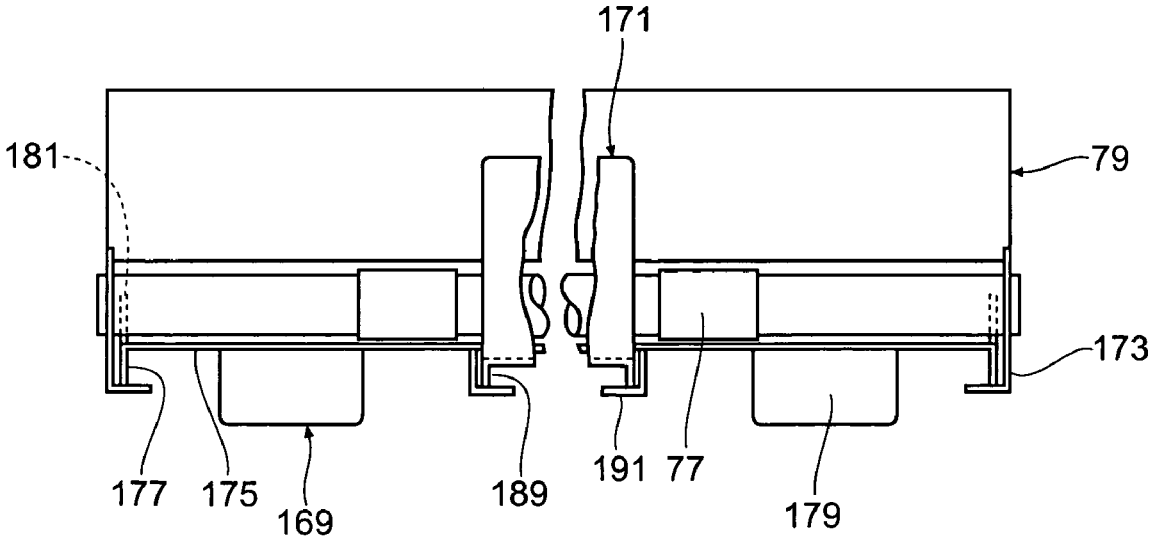
FIG. 8 is view taken along line 8—8 of FIG. 2
Figure 9:
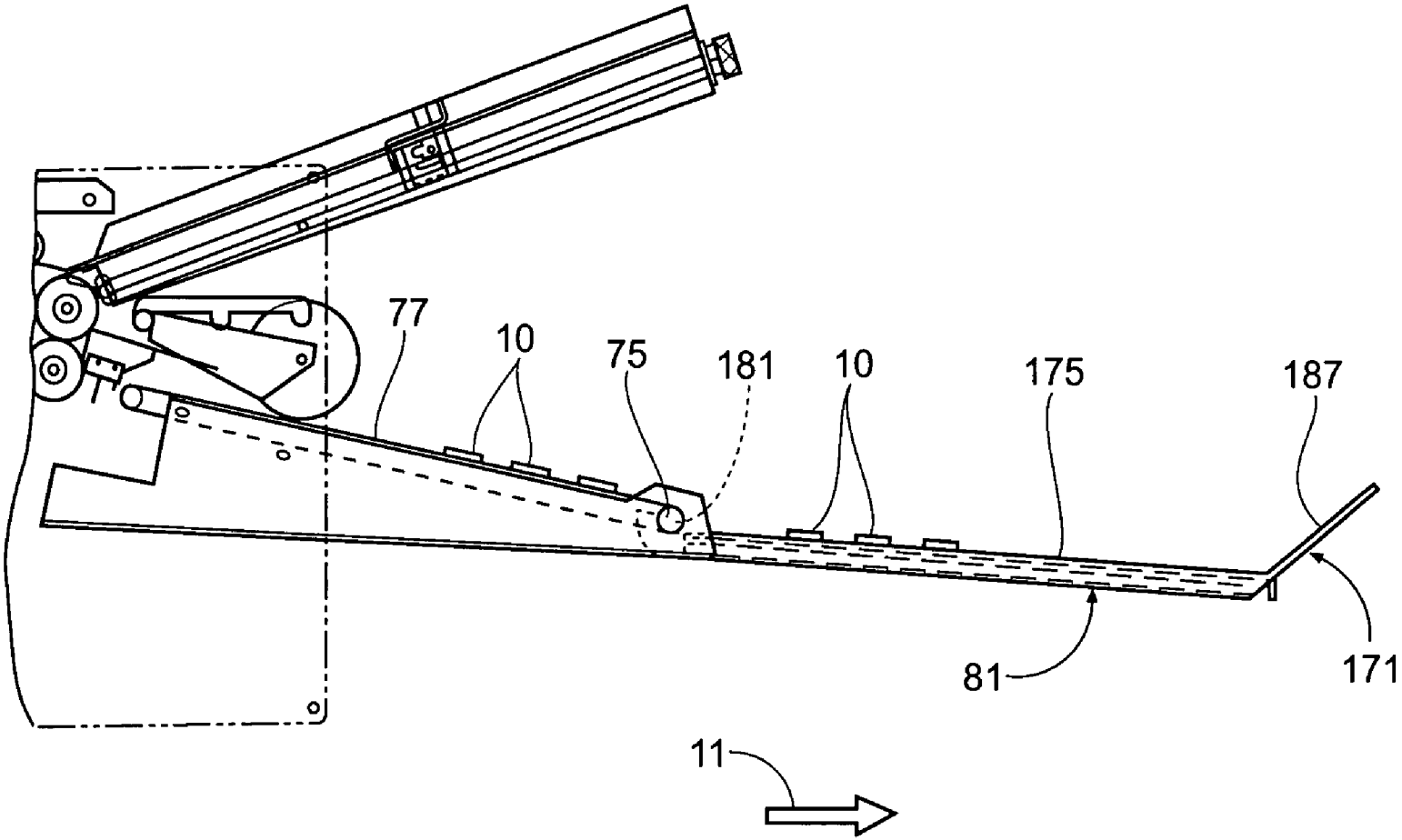
FIG. 9 is a view generally similar to FIG. 2, but showing the extension tray of the telescoping stacker in the extended location.
Figure 10:
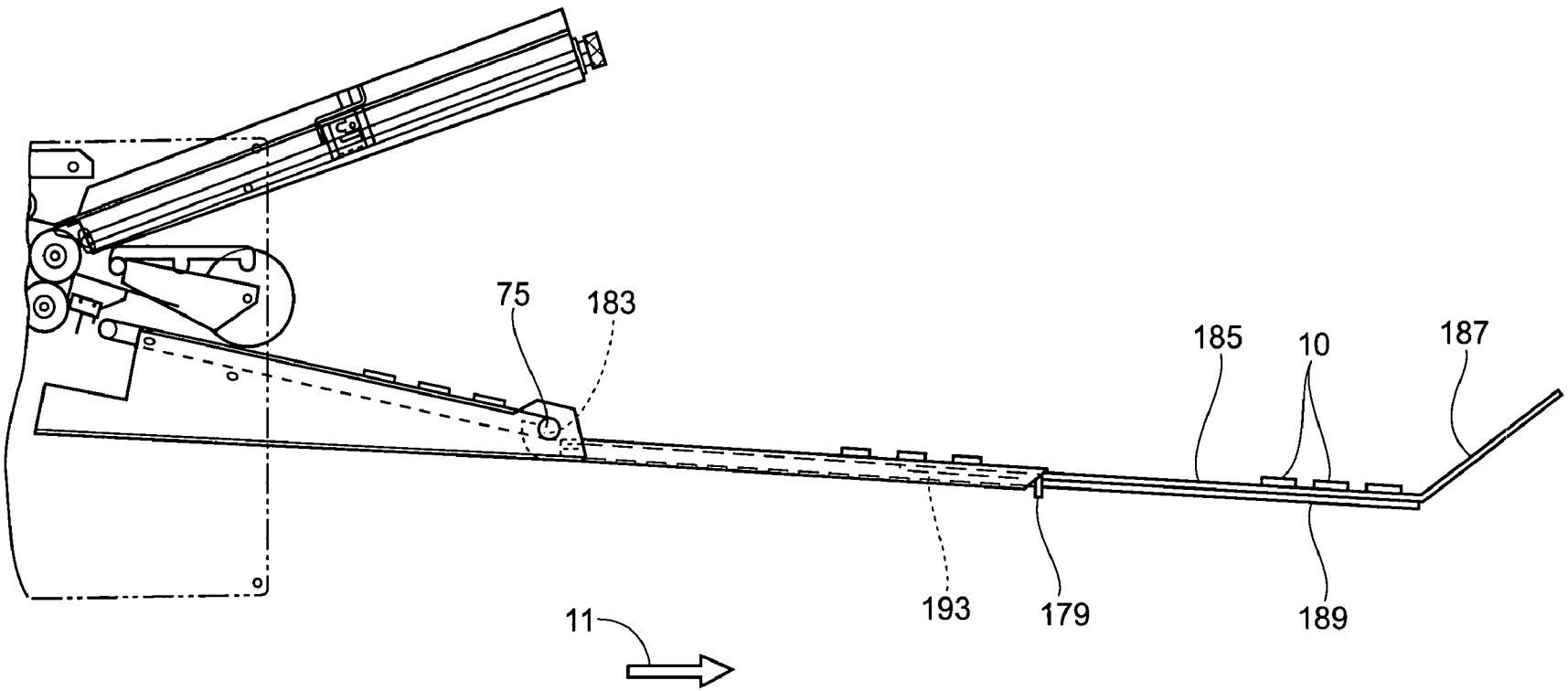
FIG. 10 is view showing the second tray of the telescoping stacker in the extended location.

Looking also at FIGS. 8–10, the telescoping stacker 81 is comprised of the deck 79 and one or more slideable trays. In the illustrated construction, the telescoping stacker has a first extension tray 169 and a second tray 171. To support the extension tray 169, the deck has a pair of allochiral flanges 173 for the full length of the deck. The extension tray has a flat base 175 with side legs 177 depending from opposite sides of the base. The extension tray legs 177 are slideable on the deck flanges 173. A pair of pull tabs 179 are on the downstream end of the base 175.

To limit the travel of the extension tray 169 on the deck 79, the extension tray further comprises a pair of stops 181. Each stop 181 may be a continuation of a side leg 177. Each stop is depicted as having an arcuate surface 183 of the same radius as the radius of the conveyor shaft 75. By pulling the pull tabs 179 in the downstream direction 11, the extension tray slides until the stops contact the conveyor shaft 75, FIG. 9. At that point, the conveyor belts 77 propel the folded sheets 10 onto the flat base 175 of the extension tray. When the extension tray is not needed, it is pushed to nest: inside the deck.

For even greater capacity of the telescoping stacker 81, the second tray 171 is used. The second tray has a top base 185 that is bent at the downstream end into an angle 187. The second tray has opposed legs 189 that are slideable on allochiral flanges 191 depending from the flat base 175 of the extension tray 169. The second tray preferably has a back leg 193. The second tray is slideable within the extension tray between a retracted location whereat it is nested within the extension tray, and an extended location whereat it extends in the downstream direction 11 from the extension tray. The back leg 193 contacts stops on the extension tray flanges 191 to limit the travel of the second tray relative to the extension tray. The lengths of the extension and second trays are designed to hold at least as many folded sheets 10 as the capacity of the in-feed hopper 15. In one embodiment of the invention, for instance, the in-feed station hopper 15 is capable of storing 500 sheets, and the telescoping stacker 81 is capable for holding 750 processed sheets. In that manner, all the sheets in a supply stack 12 loaded at the in-feed station 9 can be folded and collected at the telescoping stacker without constant attention from a person.

SUMMARY

In summary, the results and advantages of folded sheets can now be more fully realized. The folder 1 is capable of processing both individual sheets and sets of multiple sheets in an equally efficient manner. This desireable result comes from using the combined functions of the set feeder guide mechanism 101 and lower guide 134. The set feeder 83 guides a set directly to the input nip 37 of the folder station 13. Because the set by-passes the in-feed station 9, there is no danger of jamming due to multiple sheets being propelled by the feed mechanism 27. The guide mechanism 101 removeably mounts to the cover 85, which, except for the opening 97 and slots 108 and 136, may be a standard component of conventional folding machines. The versatility of the invention is further demonstrated by the fact that sets can be processed by means of the electric clutch 73, the sensing device 146, and control 163 in which case the feed mechanism does not operate. Alternately, the folder main on-off switch 161 may be used to operate the folder station to process sets, in which case the clutch and sensing device are not required. The telescoping stacker 81 has one or more trays that are extendable to hold at least as many processed sheets 10 as the capacity of the in-feed station hopper 15, so a person need not give complete attention to the folder during operation.

It will also be recognized that in addition to the superior performance of the folder 1, its construction is such as to cost little, if any, more than traditional processing machines. In fact, the versatility and increase productivity of the set feeder 83 and telescoping stacker 81 enable the folder to quickly recoup any increased initial costs.

Thus, it is apparent that there has been provided, in accordance with the invention, a folder with a telescoping stacker and a set feeder that fully satisfies the aims and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. A folder for processing thin flexible sheets comprising:

a. a frame that defines a longitudinal center plane;

b. an in-feed station in the frame that receives sheets from a source thereof and that is selectively operable to propel the sheets one at a time in a downstream direction;

c. a processing station in the frame that is selectively operable to receive the sheets from the in-feed station and process the sheets into processed sheets;

d. a telescoping stacker that receives the processed sheets from the processing station and comprising:

i. a deck fixed to the frame; and ii. at least one tray that is slideable within the deck between a first location whereat said at least one tray nests substantially within the deck, and a second location whereat said at least one tray extends in the downstream direction from the deck, so that a predetermined number of processed sheets are holdable on said at least one tray when it is in the second location; and e. a set feeder that guides a set of multiple sheets directly to the processing station and by-passes the in-feed station wherein the set feeder comprises:

i. a sensing device; and ii. means for operating the processing station but not the in-feed station in response to the sensing device sensing a set of sheets, so that the set of sheets is processed by the processing station but no sheets are propelled in the downstream direction by the in-feed station when the sensing device senses a set of sheets.

2. A folder for processing thin flexible sheets comprising:

a. a frame that defines a longitudinal center plane;

b. an in-feed station in the frame that receives sheets from a source thereof and that is selectively operable to propel the sheets one at a time in a downstream direction;

c. a processing station in the frame that is selectively operable to receive the sheets from the in-feed station and process the sheets into processed sheets;

d. a telescoping stacker that receives the processed sheets from the processing station and comprising:

i. a deck fixed to the frame; and ii. a first tray that is slideable within the deck between a first location whereat the first tray nests substantially within the deck, and a second location whereat the first tray extends in the downstream direction from the deck; and iii. a second tray that is slideable within the first tray between a first location whereat the second tray nests substantially within the first tray, and a second location whereat the second tray extends in the downstream direction from the first tray, so that processed sheets from the processing station are holdable on the first and second trays; and e. an output conveyor interposed between the processing station and the telescoping stacker that has a shaft supported on the deck, wherein the first tray comprises at least one stop that contacts the output conveyor shaft when the first tray is at its extended location.

3. The folder of claim 2 wherein the processing station is a folder station that folds the sheets into selected folded configurations.

4. The folder of claim 2 wherein:

a. the source of sheets is a stack of a predetermined number of sheets loaded at the in-feed station; and b. the telescoping stacker holds a number of the processed sheets equal to at least the predetermined number of sheets.

5. The folder of claim 2 further comprising a set feeder that guides a set of multiple sheets directly to the processing station and by-passes the in-feed station.

6. The folder of claim 5 wherein the set feeder comprises:

a. a cover in the frame that generally overlies the processing station and having an elongated opening therethrough;

b. a guide mechanism mounted to the cover in operative association with the cover opening; and c. a lower guide on the cover that cooperates with the guide mechanism and the cover opening to guide the set of sheets to the processing station.

7. The folder of claim 6 wherein the cover opening is offset from the frame longitudinal center plane.

8. The folder of claim 5 further comprising means for operating the in-feed station and the processing station simultaneously when a set of sheets is guided by the set feeder to the processing station.

9. The folder of claim 5 wherein the set feeder comprises a cover in the frame that generally overlies the processing station and having an elongated opening therethrough, the elongated opening directing the set of sheets to the processing station, so that the set of sheets by-passes the in-feed station to be processed.

10. The folder of claim 5 wherein the set feeder comprises:

a. a cover in the frame that generally overlies the processing station and having an elongated opening therethrough; and b. a guide mechanism mounted to the cover and cooperating with the cover opening to guide the set of sheets to the processing station, so that the set of sheets by-passes the in-feed station to be processed.

11. The folder of claim 5 wherein the set feeder comprises:

a. a cover in the frame that generally overlies the processing station and having an elongated opening therethrough;

b. a lower guide on the cover that cooperates with the cover opening to guide the set of sheets to the processing station, so that the set of sheets by-passes the in-feed station to be processed.

12. A folder for processing thin flexible sheets comprising:

a. a frame that defines a longitudinal center plane;

b. an in-feed station in the frame that receives sheets from a source thereof and that is selectively operable to propel the sheets one at a time in a downstream direction;

c. a processing station in the frame that is selectively operable to receive the sheets from the in-feed station and process the sheets into processed sheets;

d. a telescoping stacker that receives the processed sheets from the processing station and comprising:

i. a deck fixed to the frame; and ii. at least one tray that is slideable within the deck between a first location whereat said at least one tray nests substantially within the deck, and a second location whereat said at least one tray extends in the downstream direction from the deck, so that a predetermined number of processed sheets are holdable on said at least one tray when it is in the second location; and e. a set feeder that guides a set of multiple sheets directly to the processing station and by-passes the in-feed station and comprising:

i. a cover in the frame that generally overlies the processing station and having an elongated opening therethrough;

ii. a guide mechanism mounted to the cover in operative association with the cover opening; wherein the guide mechanism comprises: a yoke removeably mounted to the cover; a back plane joined to the yoke; and an adjuster fastened to the back plane and cooperating therewith to guide the set of sheets into the cover opening; and iii. a lower guide on the cover that cooperates with the guide mechanism and the cover opening to guide the set of sheets to the processing station.

13. The folder of claim 12 wherein:

a. the yoke has at least one tab that removeably engages an associated first slot in the cover; and b. the guide mechanism further comprises at least one latch connected to the yoke, said at least one latch being selectively pivotable to engage and disengage a second slot in the cover to thereby enable the guide mechanism to removeably mount to the cover.

14. The folder of claim 12 further comprising means for swiveling the back plane relative to the yoke to thereby change the orientation of the back plane and the adjuster relative to the cover opening.

15. The folder of claim 12 further comprising means for adjusting the adjuster relative to the back plane in directions perpendicular to the frame longitudinal center plane.

16. The apparatus of claim 12 wherein the back plane and the adjuster define a plane that slopes from the guide mechanism toward the lower guide in the downstream direction.

17. A folder for processing thin flexible sheets comprising:

a. a frame that defines a longitudinal center plane;

b. an in-feed station in the frame that receives sheets from a source thereof and that is selectively operable to propel the sheets one at a time in a downstream direction;

c. a processing station in the frame that is selectively operable to receive the sheets from the in-feed station and process the sheets into processed sheets;

d. a telescoping stacker that receives the processed sheets from the processing station and comprising:

i. a deck fixed to the frame; and ii. at least one tray that is slideable within the deck between a first location whereat said at least one tray nests substantially within the deck, and a second location whereat said at least one tray extends in the downstream direction from the deck, so that a predetermined number of processed sheets are holdable on said at least one tray when it is in the second location; and e. a set feeder that guides a set of multiple sheets directly to the processing station and by-passes the in-feed station and comprising:

i. a cover in the frame that generally overlies the processing station and having an elongated opening therethrough;

ii. a guide mechanism mounted to the cover in operative association with the cover opening; and iii. a lower guide on the cover that cooperates with the guide mechanism and the cover opening to guide the set of sheets to the processing station, wherein the lower guide comprises a paper slide having a first portion proximate the cover opening and an end proximate the processing station, the paper slide guiding a set of sheets from the cover opening to the processing station.

18. The folder of claim 17 further comprising means for cooperating with the paper slide end to form a gap through which the set of sheets pass to the processing station.

19. The folder of claim 17 wherein the paper slide has a surface that defines a large radius along which the set of sheets is guided to the processing station.

20. The folder of claim 17 further comprising a rod that cooperates with the paper slide to guide the set of sheets along the paper slide to the processing station.

21. A folder of for processing thin flexible sheets comprising:

a. a frame that defines a longitudinal center plane;

b. an in-feed station in the frame that receives sheets from a source thereof and that is selectively operable to propel the sheets one at a time in a downstream direction;

c. a processing station in the frame that is selectively operable to receive the sheets from the in-feed station and process the sheets into processed sheets;

d. a telescoping stacker that receives the processed sheets from the processing station and comprising:

i. a deck fixed to the frame; and ii. at least one tray that is slideable within the deck between a first location whereat said at least one tray nests substantially within the deck, and a second location whereat said at least one tray extends in the downstream direction from the deck, so that a predetermined number of processed sheets are holdable on said at least one tray when it is in the second location; and e. a set feeder that guides a set of multiple sheets directly to the processing station and by-passes the in-feed station wherein the set feeder comprises:

i. a sensing device;

ii. a drive train connecting the in-feed station and the processing station; and iii. means for controlling the drive train to operate the processing station but not the in-feed station in response to the sensing device sensing a set of sheets.

* * * * *